US008341851B1

(12) United States Patent
Arnold

(10) Patent No.: US 8,341,851 B1
(45) Date of Patent: Jan. 1, 2013

(54) RAILROAD SWITCH SIGNALING DEVICE

(76) Inventor: Jim Arnold, Grass Valley, CA (US)

( * ) Notice: Subject to any disclaimer, the term of this patent is extended or adjusted under 35 U.S.C. 154(b) by 0 days.

(21) Appl. No.: 13/067,684

(22) Filed: Jun. 21, 2011

(51) Int. Cl.
*G01B 5/25* (2006.01)
*B61L 5/00* (2006.01)

(52) U.S. Cl. ..... 33/651; 33/1 Q; 246/220; 246/253; 246/476

(58) Field of Classification Search ..... 33/1 Q, 33/613, 645, 521, 651, 651.1; 246/220, 253, 246/476
See application file for complete search history.

(56) References Cited

U.S. PATENT DOCUMENTS 5,009,014 A * 4/1991 Leach ..... 33/1 Q
5,806,809 A * 9/1998 Danner ..... 246/220
6,186,448 B1 * 2/2001 Wydotis et al. ..... 246/220
6,474,605 B1 * 11/2002 Wydotis et al. ..... 246/476
7,282,816 B2 * 10/2007 Ridgeway ..... 246/220
7,699,272 B2 4/2010 Arnold
2003/0106967 A1 * 6/2003 Brushwood ..... 246/220
2008/0179467 A1 * 7/2008 Wagner et al. ..... 246/220

* cited by examiner

*Primary Examiner* — G. Bradley Bennett
(74) *Attorney, Agent, or Firm* — Theodore J. Bielen, Jr.

(57) ABSTRACT

An apparatus for indicating the position of a point detector bar having an outer surface and linked to a moveable point associated with a fixed rail utilizing a probe. The probe is moveable to contact and ride on the outer surface of the point detector bar. A housing is connected to the probe and is moveable toward point detector bar also. A leg is positioned relative to the housing to form a unit. The leg is moveable within and relative to the housing when the probe contacts a certain portion of the outer surface of the point detector bar. A driver is linked to the leg and the housing unit and moves the housing and connected probe toward the point detector bar. A signal generator alerts the relative movement between the housing and leg within the housing and the probe contacts a certain portion of the outer surface of the point detector bar which may take the form of an enlarged diameter area.

10 Claims, 4 Drawing Sheets

RAILROAD SWITCH SIGNALING DEVICE

BACKGROUND OF THE INVENTION

The present invention relates to a novel and useful apparatus for indicating the position of a railroad switching point detector bar.

Railroad tracks are switched to allow trains to travel to either of two tracks which fork or split from a main track. Switch mechanisms have been deployed and used for many years by utilization of points or blades which are essentially moveable rails. Such points narrow to an edge at one end and allow the train to travel from a main track to either of two secondary tracks. Switching apparatuses which achieve this result utilize internal point lock rods that cooperate with and interact with a locking bar to holds the points against the fixed rails. Also, an internal point detector bar is employed in order to ensure that the points have completely moved against the fixed rail to achieve a proper switching of the tracks to avoid a derailment of the train. Thus, it is important to ascertain the position of the point detector bar before signals are generated indicating that it is safe for a train to travel along tracks and through the switched rails.

In the past, detection systems have been proposed which detail the movement of the points from one position to another during a switching operation. Unfortunately, the deterioration or wear of switch defecting components have caused breakdown of such detector systems and, and at times, have generated a false signal indicating that it is safe for a train to pass through the switched rails. Electronic sensors have proven not to be durable enough to operate over long time periods and have been, in general, unsuccessful in replacing mechanical systems.

Reference is made to U.S. Pat. No. 7,699,272 which details a vastly improved railroad switching indicator mechanism, and such United States Patent is incorporated by reference, as a whole, including the detailing of known prior art.

A railroad switching indicator which is reliable and accurate in indicating switching and locking of the points of a rail switching apparatus would be a notable advance in the field of transportation.

SUMMARY OF THE INVENTION

In accordance with the present invention a novel and useful apparatus for indicating a position of a point detector bar involved in a rail switching mechanism is herein provided.

The apparatus of the present invention is intended to be utilized with known point detector bars. Such point detector bars have an outer surface which are linked to a moveable point associated with a fixed rail. The outer surface of a typical point detector bar generally has outer surfaces which lie varying distances from the axes of the point detector bar. That is to say, a cylindrical point detector bar possesses a cross-sectional diameter of certain parts which are larger than the cross-sectional circular diameter of other parts.

The apparatus of the present invention utilizes a probe which is moveable towards and contacts the outer surface of the point detector bar. Such probe also slides or rolls in contact with the point detector bar as it travels. A housing is connected to the probe and is itself moveable towards the point detector bar with the probe. A leg is also employed and is positioned relative to the housing to form a unit. The leg may be positioned external or internally relative to the housing. In any case, the leg is generally moveable with the housing but is moveable relative to the housing upon the probe contacting a certain portion of the outer surface of the point detector bar. In most cases, such outer surface of the point detector bar may be a thickened portion or one of a large diameter, as heretofore described. Moreover, in certain embodiments, the housing may possess a chamber such that the leg lies at least partially within the chamber. Relative movement between the leg and the housing upon contact of the probe with a certain portion of the point detector bar permits the leg to extend outside the chamber. At least one spring is located in the housing and is positioned to bear on the leg in order to bias the same into a position within the housing chamber.

The invention also includes a driver which is linked to the leg of the leg and housing. The unit, including the leg, the housing, and connected probe is moved by the driver toward the point detector bar. Such movement takes place as the point detector bar generally travels laterally relative to the contacting probe as a result of the movement of the rail points, which takes place during switching of the rail points.

A signal generator, such as a microswitch, also forms part of the present invention and alerts the relative movement between the housing and the leg when the probe contacts a certain portion of the outer surface of the point detector bar. Such signal generally indicates whether the point detector bar has or has not moved according to a prescribed distance, determining the complete or incomplete movement of the points adjacent the rails of the rail system. In other words, the present invention indicates if there has or has not been a complete switching of a point from one rail to another rail. The signal generator may further comprise a follower linked to the microswitch. The follower contacts the outer surface of the housing. The housing is also formed with a surface disparity, which may be a depression, such that contact of the follower on the housing surface outside such disparity indicates an incorrect positioning of the moveable point relative to the fixed rail. Of course, such positioning of the follower is coordinated with the probe also contacting a certain portion of the point detector bar, which also indicates a proper or incorrect positioning of a moveable point or points.

In addition, the apparatus of the present invention may include a pin which extends through the housing. The leg would include an aperture to allow the pin to occupy such aperture upon the relative movement between the housing and the leg indicating an incorrect positioning of a point or points. In other words, the pin would serve to lock the leg relative to the housing in a certain position to memorialize indication of an incorrect positioning of a point or points. Of course, the pin may be reset by removing the same from the aperture to rearm the apparatus of the present invention. The pin may be spring loaded, in this regard, to automatically extend into the leg aperture when an incorrect positioning of a rail point takes place.

It may be apparent that a novel and useful apparatus for indicating the position of a point detector bar has been hereinabove described.

It is therefore an object of the present invention to provide an apparatus for indicating the position of a point detector bar which reliable and accurate and is capable of realizing an incorrect positioning of points associated with a fixed rail during railroad switching operations.

Another object of the present invention is to provide an apparatus for indicating the position of a point detector bar which eventually generates a signal that alerts the operator of a rail vehicle that an incorrect switching has taken place.

A further object of the present invention is to provide an apparatus for indicating the position of a point detector bar which prevents derailments of railroad trains.

Another object of the present invention is to provide an apparatus for indicating the position of a point detector bar includes a locking mechanism insuring that a signal indicating a miss-positioning of a railroad point is generated and further operation of a switching mechanism is prohibited.

Another object of the present invention is to provide an apparatus for indicating the position of a point detector bar which is compatible with existing point detector bars and is retrofitable into a signaling device associated with a rail switching mechanism.

The invention possesses other objects and advantages which will be apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 6:
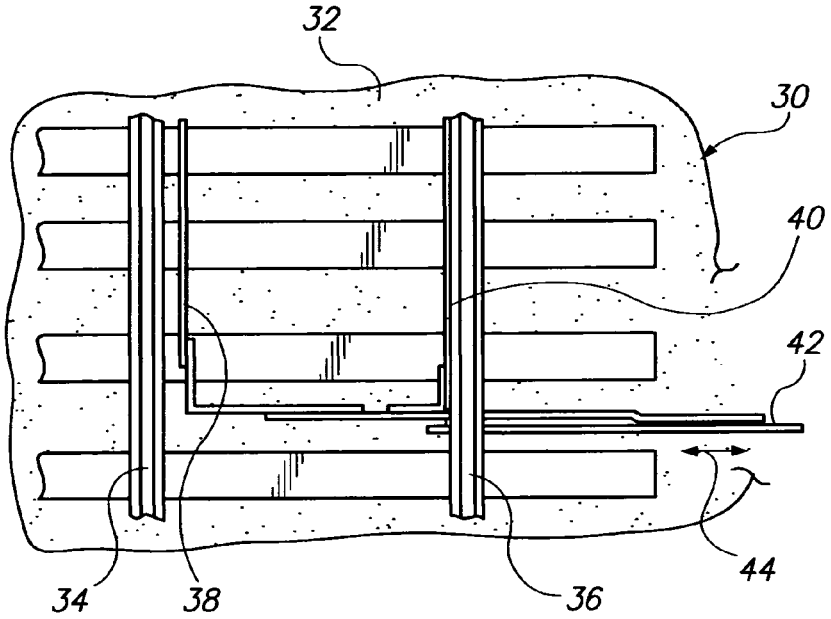
FIG. 6 is a partial top plan view of a switching area of a railroad track.

An embodiment of the invention as a whole is depicted in the drawing by reference character 10. Apparatus 10 includes as one of its elements a probe 12 which takes the form of a wheel 14 held for rotation within a fork 16, such wheel 14 rotating according to directional arrow 18. The probe is intended to be employed with a point detector bar 20 which is a moveable elongated member such as a cylindrical rod. Point detector bar 20, includes a central axis 22 and portions 24 and 26 of relatively large diameter as well as portion 28 of a lesser diameter relative to axis 22, FIG. 1. With reference to FIG. 6, it may be observed that railroad ties 30 lie on a railroad bed 32 to support fixed rails 34 and 36. Points or blades 38 and 40 are moved between fixed rails 34, 36 electrical or manually, through a conventional mechanical linkage (not shown). An internal point detector bar or indicator rod 42 moves with points 38 and 40, directional arrow 44. The distance of travel of point detector bar 42 represents the unsuccessful or successful movement of points or blades 38 and 40 in a railroad switching operation. Probe wheel 14 is moveable towards point detector bar 20, directional arrow 46, contacts the outer surface 48 of point detector bar 20. Probe wheel 14 also slides or rolls therealong as point detector bar 20 travels laterally, directional arrow 50. Fork 16, supporting wheel 14, attaches to a shaft 52 and is fixed to a bracket 54. Bracket 54 is itself fixed to a housing 56. Thus, probe 14 is linked or connected to housing 56 for movement therewith, toward point detector bar 20 directional arrow 46. Support 58 is held to housing 56 and includes a ridge 60 that lies beneath rotatable grooved wheels 62 and 64. Groove wheels are rotatable relative to stanchion 66 which is fixed to a surface 68. Shaft 70 extends from support 58 and connects to a crank 72 via L-shaped arm 74. Rotatable discs 76 and 78 turn with the movement derived from a known motor 75 found in the conventional locking mechanism (not shown) of the switch apparatus when rail switching takes place, concomitant with the movement of the point detector bar 20. The rotational movement of discs 76 and 78, to a linked locking bar (not shown), is depicted by directional arrow 80. In essence, probe wheel 14 moves to the outer surface 48 of point detector bar and rides therealong as point detector bar moves according to directional arrow 50. The urging of probe wheel 14 to surface 48 is accomplished by the rotation of disc 70 and 78 and crank arm 72 through the driver linkage heretofore described, to wheel 14.

Figure 1:
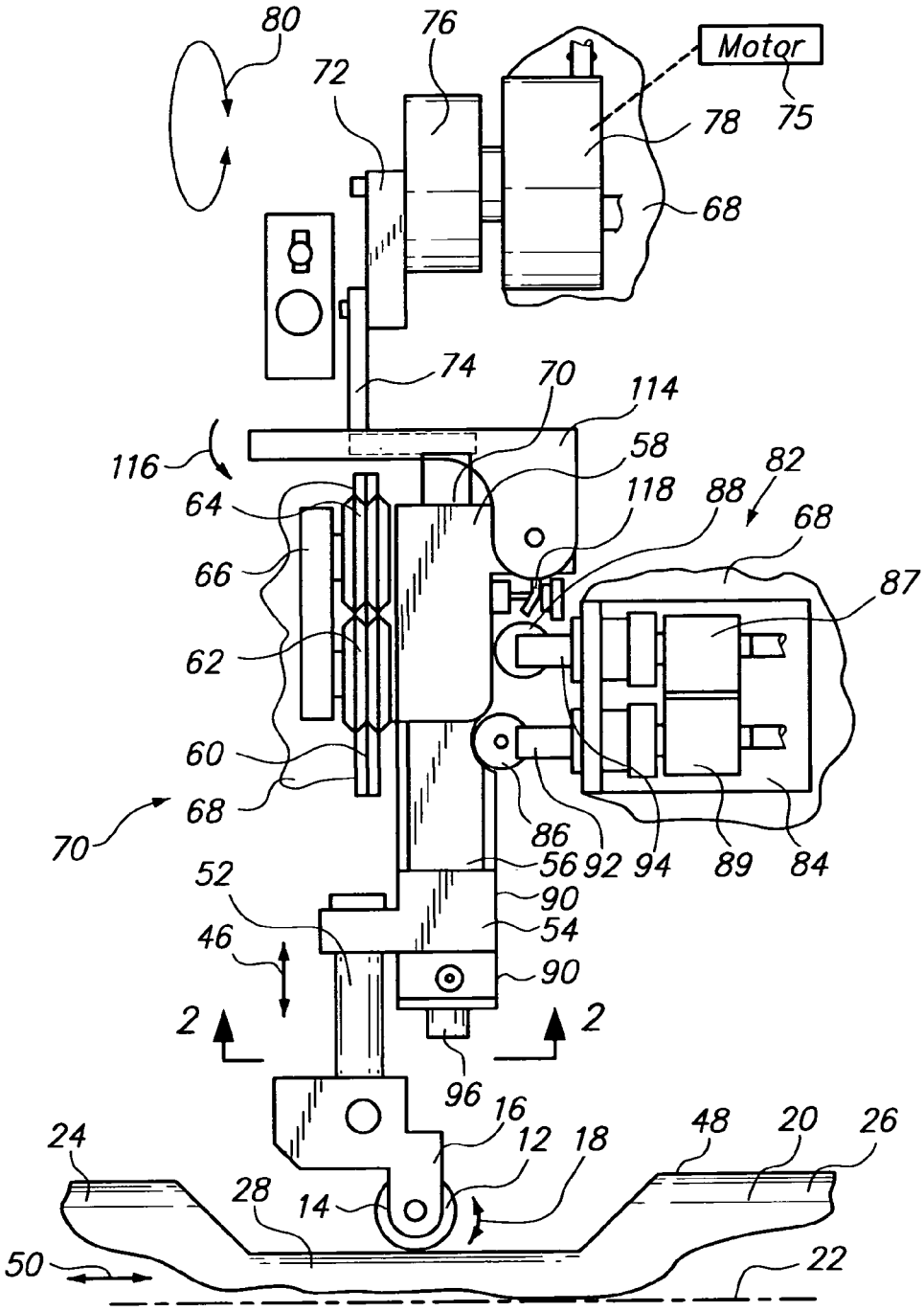
FIG. 1 is a top plan view of the apparatus of the present invention.
Figure 2:
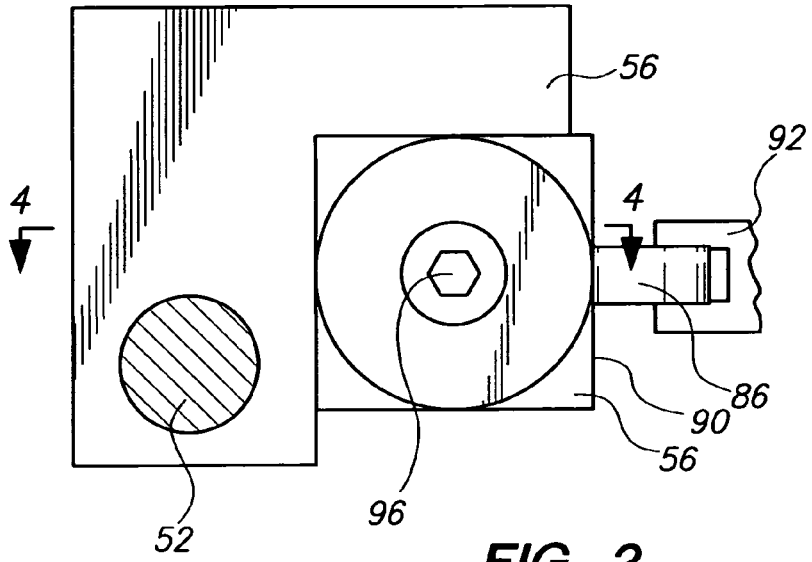
FIG. 2 is an enlarged sectional view taken along line 2-2 of FIG. 1.
Figure 3:
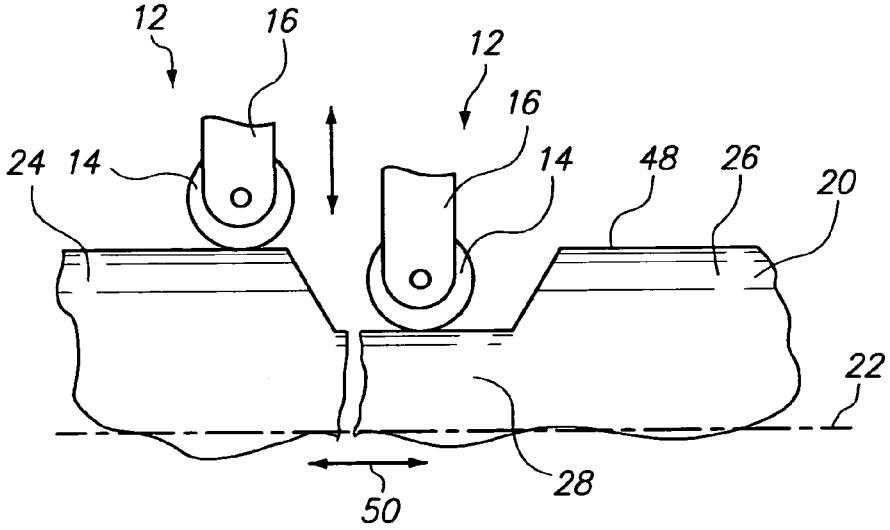
FIG. 3 is a partial side elevational view of the point detector bar depicting the probe of the present apparatus in two positions.

Looking again at FIG. 1, it may be observed that a signal generator 82 is shown having a base 84 and microswitches 87 and 89 of conventional configuration. Microswitches 87 and 89 sound signals to a mechanical electronic or other system to provide a "lockout" should points 38 and 40 not completely effect switching with respect to rails 34 and 36. The followers 86 and 88 ride on the outer surface 90 of housing 56. Followers 86 and 88 are spring loaded and mounted between split members 92 and 94; FIGS. 1 and 2. Needless to say, the movement of followers 86 and 88 are mechanically linked to the operation of micro switches 87 and 89. FIG. 2 represents a view of follower 86 riding on surface 90 outside of any depressions, protuberance or other surface disparity found on the outer surface 90 of housing 56. Likewise, FIG. 3, represents the movement of probe wheel 14 between large diameter portion 24 of point detector bar 20 (incomplete point movement) and small diameter portion 28 of point detector bar 20 (complete point movement), as point detector bar moves according to directional arrow 50. Probe wheel 14 may touch or lie in close proximity to small diameter portion 28 of point detector bar 20.

Figure 4:
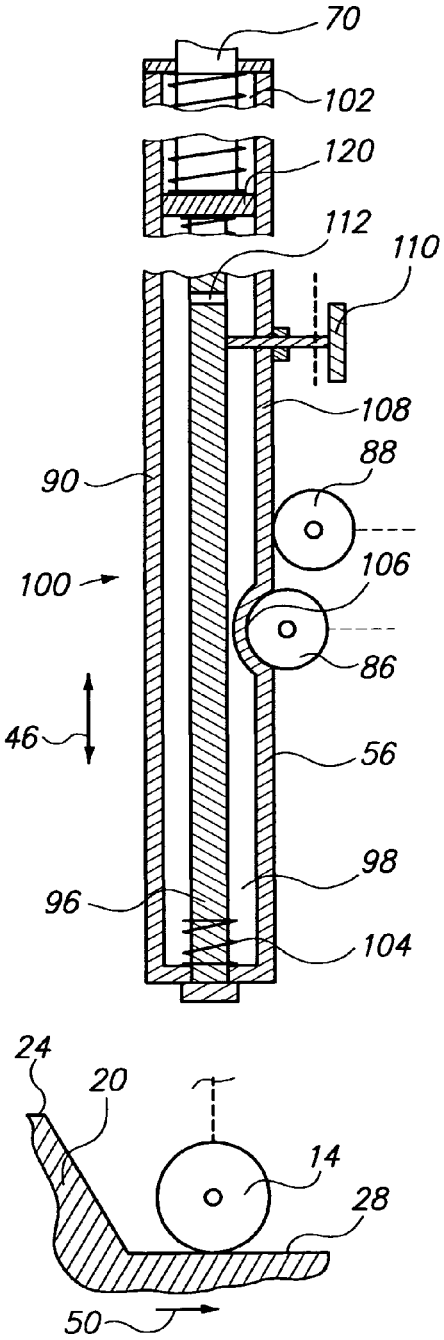
FIG. 4 is a sectional view taken along line 4-4 of FIG. 2.
Figure 5:
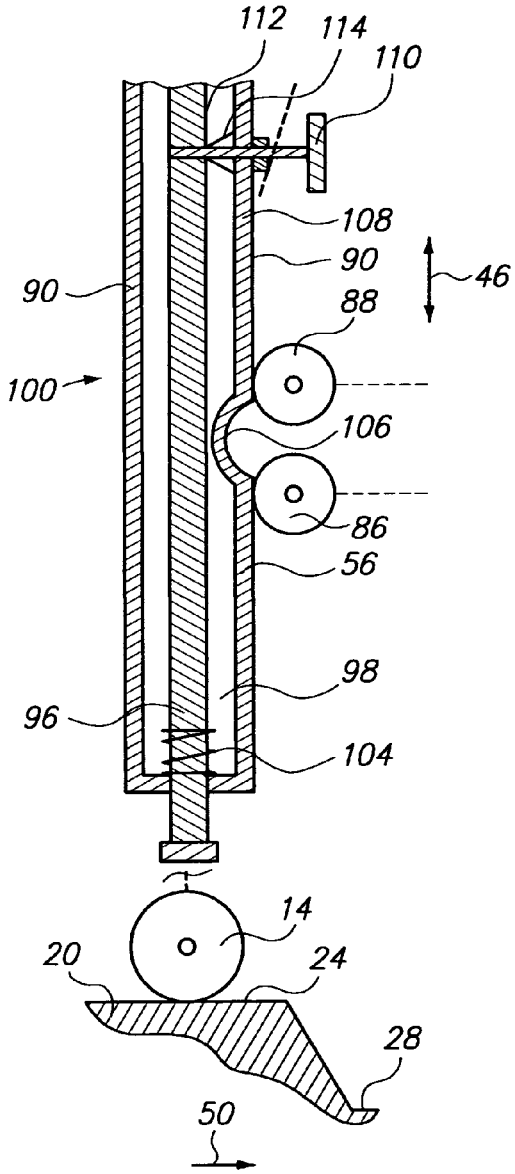
FIG. 5 is a sectional view similar to that shown in FIG. 4 with the leg and probe in another position from that shown in FIG. 4.

Turning now to FIGS. 4 and 5, it may be observed that details with respect to housing 56 are shown. Leg 96 is positioned relative to housing 56 and, in the embodiment shown in FIGS. 4 and 5 lies within chamber 98 of housing 96. Leg 96, housing 56 and connected probe 12 form a unit 100. Leg 96 is generally moveable with housing 56 through the motion imparted by crank 72 and rotating discs 76 and 78, via the linkage described hereinabove. Springs 102 and 104 hold leg 96 in the positioned shown in FIGS. 1 and 4. As depicted in FIG. 4, when probe moves into small diameter portion 28 of point detector bar 20 leg remains within chamber 98 of housing 56. In addition, follower 86 enters recess 106 (which may also take the form of a protuberance formed in the housing wall 108 in this configuration), FIG. 4, when point detector bar 20 has fully moved, laterally, indicating that point 40 is against fixed rail 36, FIG. 6. However, should probe wheel 14 remain on large diameter portion 24 of point detector bar 20, FIG. 5, leg 96 will continue to travel and extend partially from chamber 98. Also, at this juncture, follower 86 lies on the outer surface 90 of housing 56 outside recess 106. Such position of follower 86 will trigger microswitch 89 into generating a signal warning traffic that a complete switching of point 40 has not taken place such signal is sent to an electronic, mechanical or other mechanism (not shown) to create a "lockout" which must be reset to provide operability to rails 34 and 36. It should be noted that shaft 70 connects directly to leg 96 to achieve this result.

Again, with reference to FIG. 5, when exampler point 40 has not completely moved against fixed rail 36 and point detector bar has not completely moved to the position of FIG. 4, a pin 110 which extends into the chamber 98 of housing 56 enters an aperture 112. Pin 110 is biased into this position, FIG. 5 by spring 114. Thus, leg 96 is locked out from chamber 98 in the position shown in FIG. 5, to prevent further operation of apparatus 10. With reference to FIG. 1, lever 114 is rotated according to directional arrow 116 such that flange 118 removes pin 110 from aperture 112 and into its position illustrated in FIG. 4. At this point, spring 104 will again reset leg 96 into the position shown in FIG. 4 by pushing on end piece 120, FIG. 4, in the form of a collar around leg 96. It should be realized that a similar apparatus 10 may be employed to detect the movement of point 40 in the opposite direction to that shown in FIG. 5.

Figure 7:
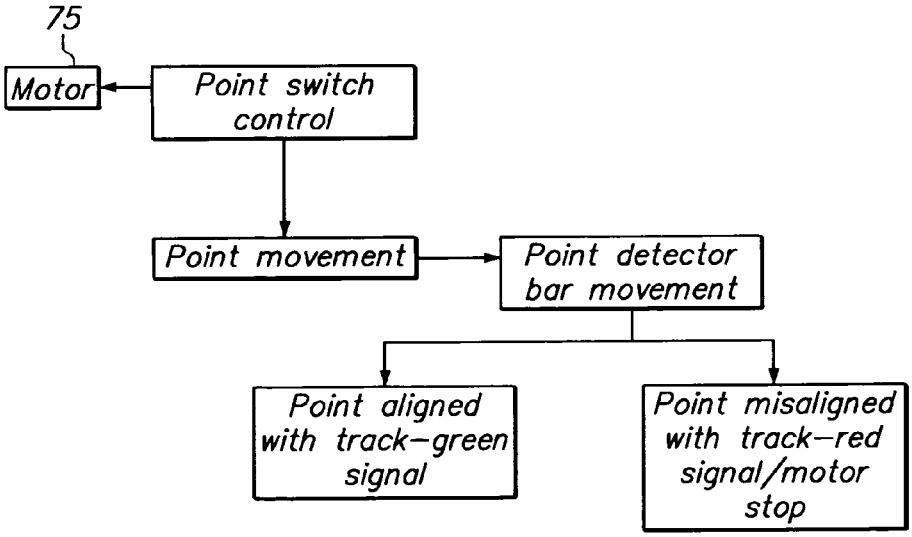
FIG. 7 is a block diagram indicating the functioning of the apparatus of the present invention.

In operation, a motor, FIG. 7, operates the point switch control, FIG. 7, which normally operates switching mechanism moving points 38 and 40 between fixed rails 34 and 36. Point movement also moves point detector bar 20 according to directional arrow 44, FIG. 6, and directional arrow 50, FIGS. 1, 4, and 5. In the example shown in the drawings, the movement of point detector bar 20 to the right on FIG. 6, forces probe wheel 14 to initially ride on the large diameter portion 24 of surface 48 of point detector bar 20. Probe wheel and housing 56, unit 100, is urged toward point detector bar 20 by a driver linkage operated by motor 75. Upon probe wheel 14 reaching, being in close proximity of, or touching, small diameter portion 28 of point detector bar 20, follower 86 of the signal generator 82 enters a surface disparity or recess 106 in the wall 108 of housing 56, FIG. 3. At this point, a signal is generated through microswitch 89 indicating the proper switching of points 38 and 40. However, should point detector bar 20 not travel the proper distance, FIG. 5, probe 14 will lie on large portion 24 of point detector 20. At this point, leg 96 will continue to move relative to housing 56 and extend therefrom. This will cause follower 86 to lie outside recess 106 and trigger a danger signal and a "lockout" reaction through a signal generator, such as micro switch 89, indicating that points 38 and 40 have not completely moved relative to fixed rails 34 and 36. Pin 110 will enter aperture 112, in rod 96, at this point, to lock the unit 100 into the position shown in FIG. 5. Of course unit 100 may also be electronically locked-out from the signal generated by microswitch 89. The movement of lever 114 will release pin 110 and allow the unit 110 to assume the configuration shown in FIG. 4 once the position of points 38 and 40 has been corrected automatically or manually.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for indicating the position of a point detector bar having an outer surface linked to a movable point associated with a fixed rail comprising:

a. a probe, said probe being movable toward and contacting the outer surface of the point detector bar;

b. a housing connected to said probe and being movable toward the point detector bar;

c. a leg, said leg positioned relative to said housing to form a unit, said leg being movable with said housing, said leg further being movable relative to said housing upon said probe contacting a certain portion of the outer surface of the point detector bar;

d. a driver, said driver being linked to said leg and housing unit, moving said housing and connected probe toward the point detector bar; and e. a signal generator, said signed generator alerting said relative movement between said housing and said leg upon said probe contacting or lying in close proximity to a certain portion of the outer surface of the point detector bar.

2. The apparatus of claim 1 in which said unit comprises said housing having a chamber and said leg lies at least partially in said chamber said relative movement between said leg and said housing permitting said leg to extend outside said chamber.

3. The apparatus of claim 2 which additionally comprises at least one spring located in said housing chamber said spring being linked to said leg.

4. The apparatus of claim 1 in which said signal generator comprises a follower, and said housing includes an outer surface, said follower contacting said outer surface of said housing said movement of said housing toward the point detector bar causing relative movement between said follower and said outer surface of said housing, said housing outer surface further including a surface disparity, said follower not contacting said surface disparity indicating an incorrect position of the moveable point relative to the fixed rail.

5. The apparatus of claim 4 in which said unit comprises said housing having a chamber and said leg lies at least partially in said chamber said relative movement between said leg and said housing permitting said leg to extend outside said chamber.

6. The apparatus of claim 5 which additionally comprises at least one spring located in said housing chamber said spring being linked to said leg.

7. The apparatus of claim 1 which additionally comprises a pin, said pin extending through said housing and said leg includes an aperture said pin occupying said aperture upon the relative movement between said housing and said leg.

8. The apparatus of claim 7 in which said unit comprises said housing having a chamber and said leg lies at least partially in said chamber said relative movement between said leg and said housing permitting said leg to extend outside said chamber.

9. The apparatus of claim 8 which additionally comprises at least one spring located in said housing chamber said spring being linked to said leg.

10. The apparatus of claim 7 in which said signal generator comprises a follower, and said housing includes an outer surface, said follower contacting said outer surface of said housing said movement of said housing toward the point detector bar causing relative movement between said follower and said outer surface of said housing, said housing outer surface further including a surface disparity, said follower not contacting said surface disparity indicating an incorrect position of the moveable point relative to the fixed rail.

* * * * *